United States Patent [19]

Ruger et al.

[11] Patent Number: 4,627,184

[45] Date of Patent: Dec. 9, 1986

[54] EJECTOR MANUALLY OPERABLE TO ROTATE FIRING PIN BLOCK FOR SLIDE REMOVAL AND DISASSEMBLY

[75] Inventors: William B. Ruger, Croydon, N.H.; Lawrence L. Larson, Branford, Conn.

[73] Assignee: Sturm, Ruger & Company, Inc., Southport, Conn.

[21] Appl. No.: 661,522

[22] Filed: Oct. 16, 1984

[51] Int. Cl.[4] ..... F41C 15/06

[52] U.S. Cl. ..... 42/25; 42/75.03; 89/196

[58] Field of Search ..... 42/25, 75 A, 75 B, 75 C; 89/196, 163; 24/617, 651

[56] References Cited

U.S. PATENT DOCUMENTS 1,176,254 3/1916 Smith ..... 89/196
3,394,482 2/1967 Badali ..... 42/25

*Primary Examiner*—Deborah L. Kyle
*Assistant Examiner*—Michael J. Carone
*Attorney, Agent, or Firm*—Pennie & Edmonds

[57] ABSTRACT

An ejector for automatic pistols having a reciprocating breech block, or slide, the ejector capable of being manually moved from an operating cartridge ejecting position to a disassembly position where it lowers a frame-mounted firing pin block and permits the slide to be disassembled by sliding forwardly. A slide latch arrangement permits the slide latch pivot axle to be held in a partially withdrawn mode during disassembly. When the pistol's magazine is in place, it holds the ejector in the operating position.

7 Claims, 22 Drawing Figures

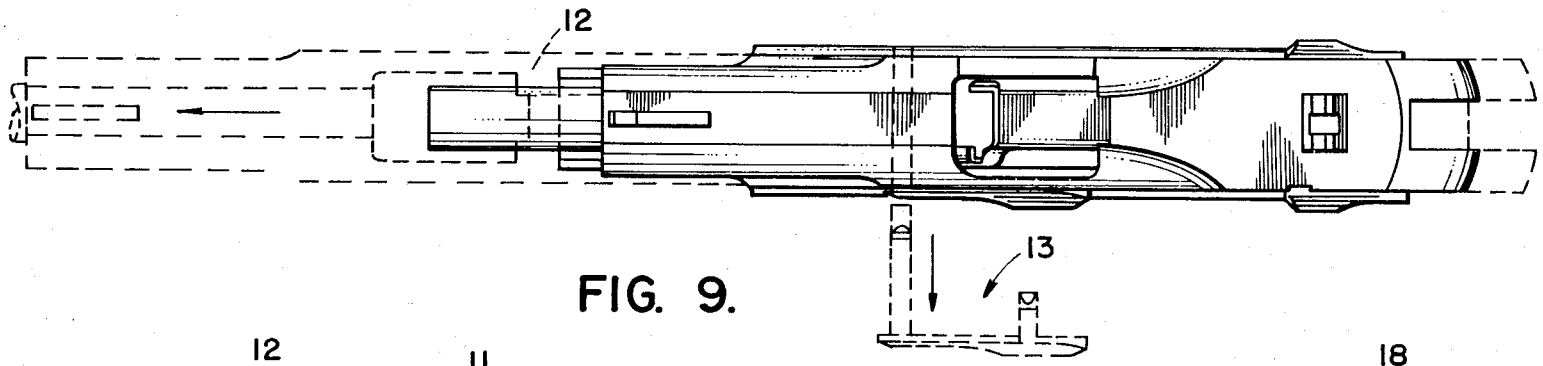
FIG. 9.
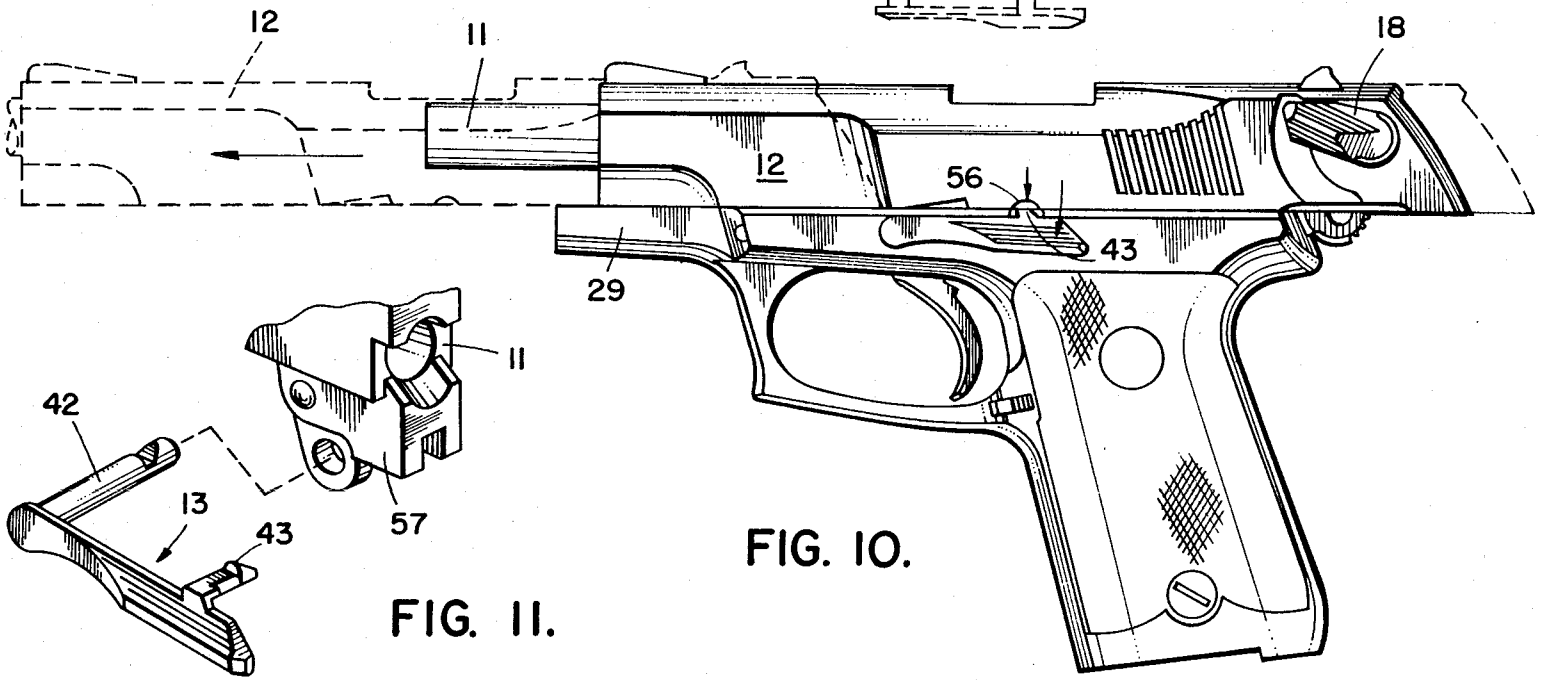
FIG. 10.
FIG. 11.

EJECTOR MANUALLY OPERABLE TO ROTATE FIRING PIN BLOCK FOR SLIDE REMOVAL AND DISASSEMBLY

BACKGROUND OF THE INVENTION

Prior semi-automatic pistols have included slides carrying reciprocating firing pins; have included firing pin blocking devices, and have included ejectors which eject cartridges from the pistol. In semi-automatic pistols employing firing pin blocking mechanisms which extend up from the grip frame into a slide cavity, slides have required clearance cuts to permit their removal during disassembly of the pistol. Prior firearms have not provided or suggested a ready arrangement for slide removal in such pistols without providing these clearance cuts, through which debris can enter, with undesirable results.

Some pistols are also disassembled by removal of the slide latch, which permits the slide to be removed from the pistol. This system permits the slide latch to become separated from the pistol, with the risk of possible loss or damage to this essential part.

SUMMARY OF THE INVENTION

Broadly, the present invention is a novel semi-automatic pistol arrangement in which the cartridge ejector lever is pivotably mounted on the pistol frame to function in a first position as an ejector and in a second position to rotate the firing pin blocking piece until the blocking piece projection (normally projecting up into a slide recess to block the firing pin) is removed from interfering with a slide not carrying clearance cuts at its rearward end. The elongated ejector lever carries a finger leg for engagement with the blocking piece to rotate the blocking piece to permit disassembly of the slide. Over-centering means provide for first positioning the lever in its ejector position and later in its blocking piece rotation position. Once the blocking piece is rotated for disassembly, the slide latch is partially withdrawn from the pistol but is not totally removed, with spring and annular groove means to prevent loss or damge of the slide latch.

It is a feature of the invention that the ejector may also be shaped to engage and be stabilized by the magazine.

BRIEF DESCRIPTION OF THE DRAWINGS

FIG. 9 is a plan view showing the slide latch and slide being removed;

FIG. 10 is a side elevational view showing the slide catch being depressed to prepare for its removal;

FIG. 11 is a perspective exploded view of the slide catch and its mount on the barrel extension piece;

DESCRIPTION OF THE PREFERRED EMBODIMENT

Figure 1:
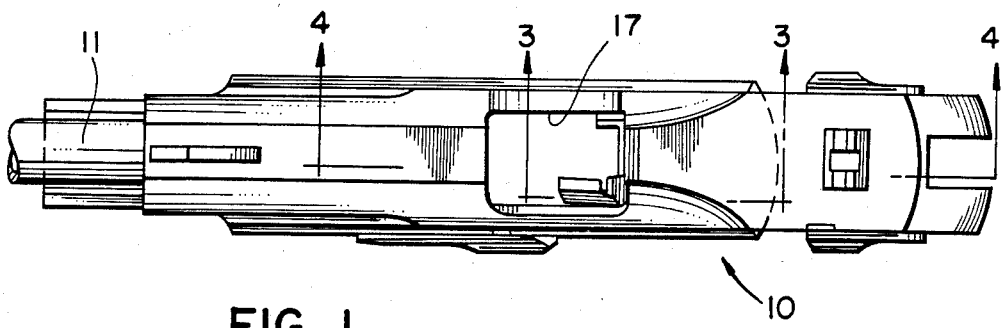
FIG. 1 is a partial plan view of the pistol.
Figure 2:
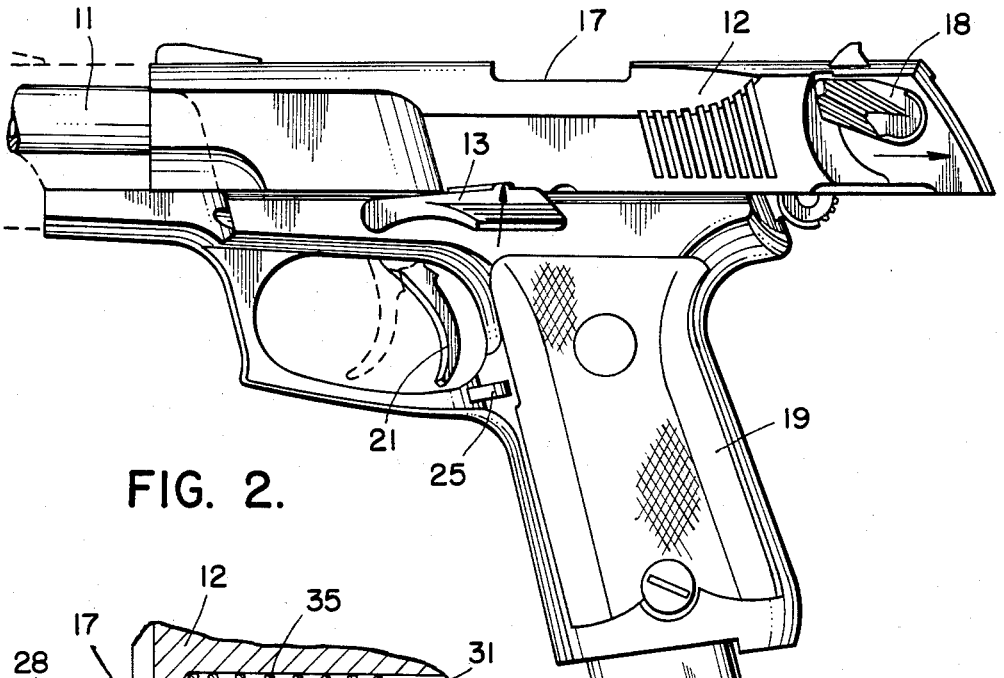
FIG. 2 is a partial side elevational view of the pistol with the slide locked back and the magazine being removed.
Figure 3:
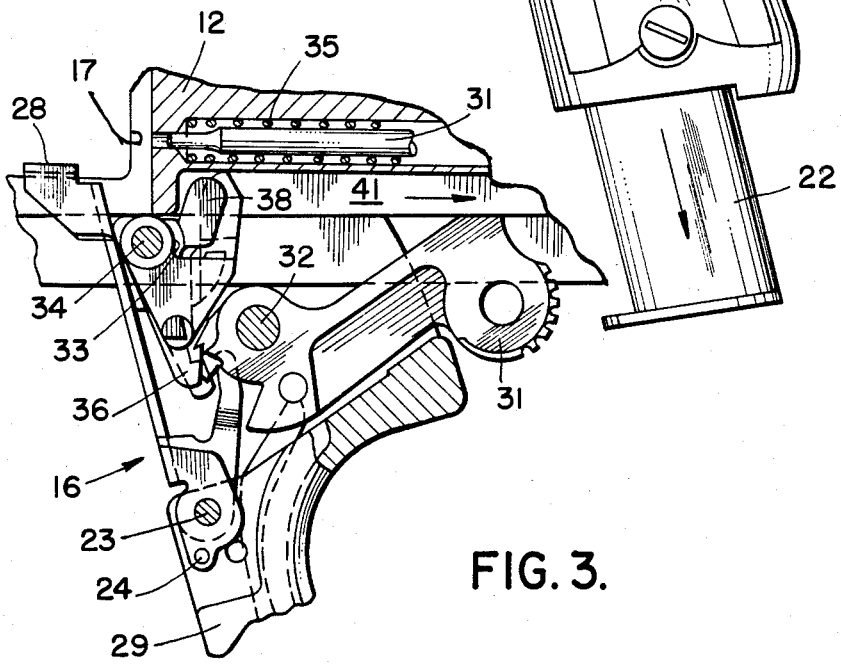
FIG. 3 is a sectional view along line 3—3 of FIG. 1.

In FIGS. 1-2, pistol 10 includes barrel 11, slide 12, slide lock 13, pivotable cartridge ejector lever 16, cartridge ejection port 17, manual safety lever 18, grip 19, trigger 21, magazine 22, and magazine latch 25.

Figures 4, 5, 6:
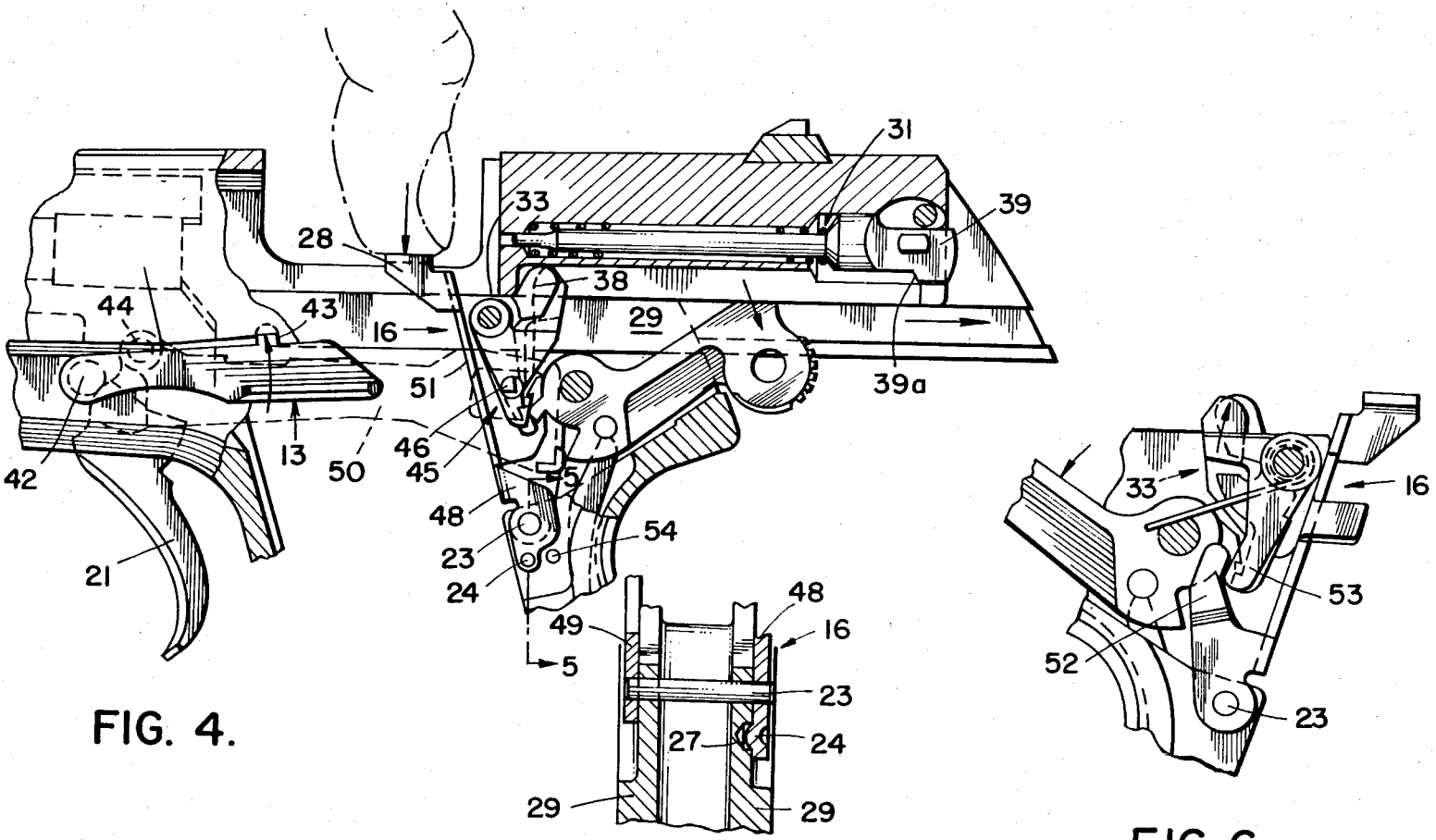
FIG. 4 is a sectional view along line 4—4 of FIG. 1.
FIG. 5 is an elevational sectional view along line 5—5 of FIG. 4.
FIG. 6 is a partial reverse side view of the ejector lever; the hammer; and related parts.

Turning to FIGS. 3-6, cartridge ejector lever 16 is shown in its normal ejector position being held firmly in place to withstand forces to which it is subjected during ejection by frame 29 limiting its rearward movement and, in addition, lever 16 is stabilized in such ejector position by pivot pin 23 in combination with detent 24 and frame detent recess 27 (see FIG. 5). In this ejection position, lever 16 serves to eject spent cartridges during operation of the pistol through engagement of cartridges with cartridge-engaging lip 28 which projects into the path of cartridge cases which are carried by reciprocating slide 12 causing the cases to be ejected through port 17.

Pivot pin 23 is mounted on pistol frame 29. Also on frame 29 are hammer 31 which rotates about hammer pivot 32; firing pin block 33 on pivot 34 and sear 36 also on pivot 34. Firing pin blocking piece 33 including its upstanding projection 38 is mounted on the frame. Projection 38 extends above frame 29 and engages surface **39*a* of firing base portion 39 (FIG. 4) to block movement of firing pin 31. Since projection 38 is at all times in its upstanding position (except just before and during firing) projection 38 prevents removal of slide 12 which does not have clearance cuts unless and until moved out of slide recess 41 in which it normally projects. Also shown is firing pin spring 35**.

With further reference to FIG. 4, slide lock 13 includes lock pivot axle 42 (see also FIG. 11) and latch piece 43 which piece 43 is lifted by magazine follower (not shown) to latch slide 12 open after the last cartridge has been expended.

Trigger 21 is connected to trigger bar 40 through pivot pin 44. Trigger bar 40 has an opening 45 the sides of which engage firing pin block side extension 46 causing, during portions of the operating cycle, rotation of the firing pin blocking piece 33 clockwise (FIG. 4) to unblock firing pin 31.

With reference to FIG. 5, lever pivot pin 23 is shown mounted in frame 29. Secured to pin 23 are ejector wings 48, 49 of ejector lever 16 having a detent 24 in wing 48 which detent 24 rests in ejector detent recess 27 located in frame 29. Ejector cartridge lip 28 is connected to wings 48, 49 by ejector stem 51.

Turning to FIG. 6, lever wing 49 carries a wing extension portion 52 which engages extension 53 of blocking piece 33 to rotate blocking piece 33 as hereinafter described.

Figures 7, 8:
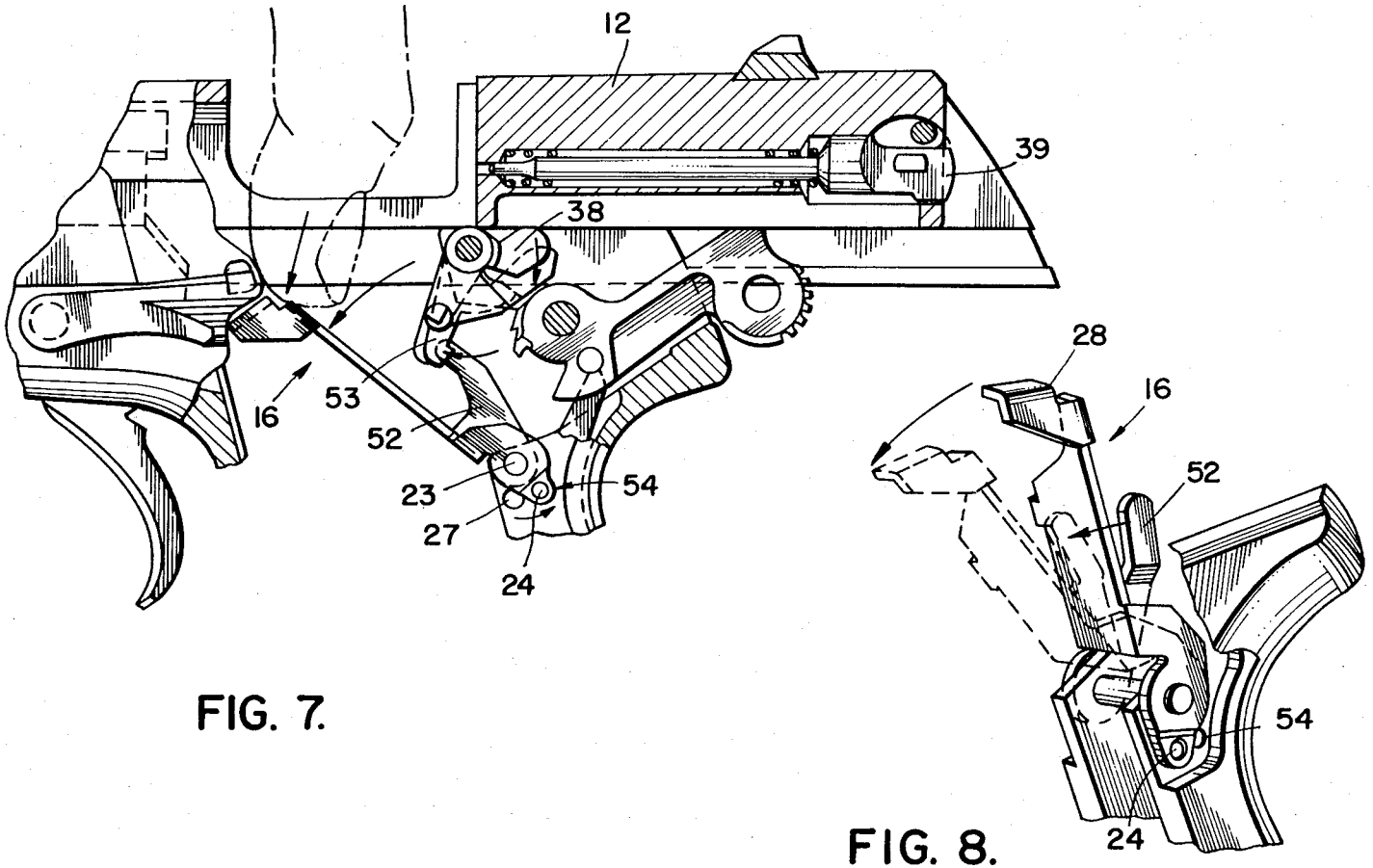
FIG. 7 is a sectional view similar to FIG. 4 showing the ejector lever manually depressed to rotate the blocking piece to its unblocking position.
FIG. 8 is a perspective view of the ejector lever mounted on the pistol frame.
Figure 12:
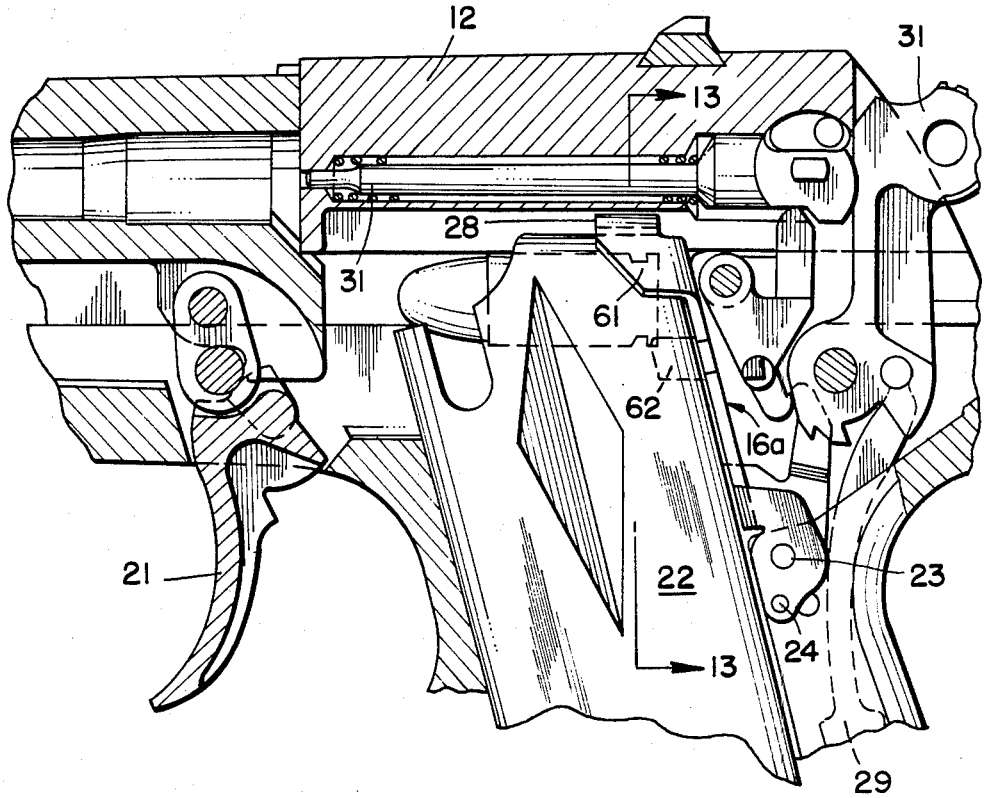
FIG. 12 is a partial sectional elevational view showing an alternative embodiment in which the slide is forward; magazine in position and ejector lever in its ejector mode.
Figure 13:
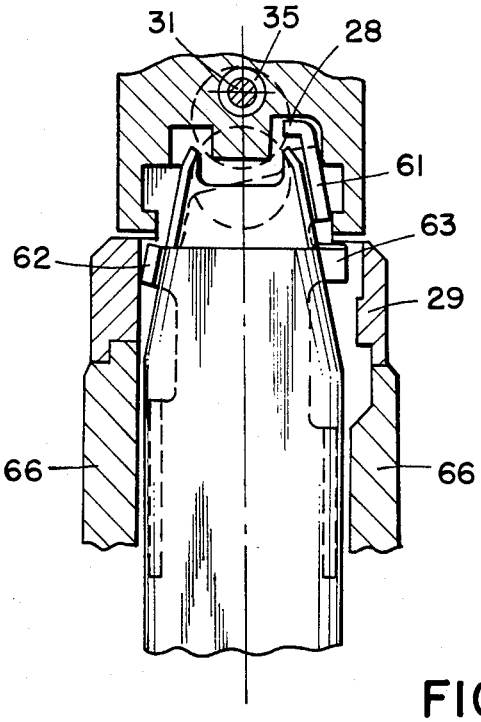
FIG. 13 is a sectional view along line 13—13 of FIG. 12.

Directing attention now to FIGS. 7 and 8, it is seen that depression of ejector lever 16 by pushing down on its upper portion causes detent 24 to snap out of detent recess 27 and allow lever 16 to rotate counterclockwise until detent 24 snaps into firing pin blocking piece detent recess 54. As lever 16 is so rotated, extension 52 engages arm extension 53 of blocking piece 33 to lower projection 38 below slide 12. Upon removal of the manual force, ejector lever 16 is held by detent 24 in detent recess 54 (FIG. 7). As blocking piece 33 is rotated by lever 16, blocking piece 33 engages and rotates sear 36.

Turning now to FIGS. 9, 10, and 11, to remove slide 12 with the firing pin blocking projection 38 in its firing pin blocking piece actuation position, the slide latch 13 is manually depressed to permit latch element 43 to clear slide notch 56 (FIGS. 10 and 11) and the latch 13 is then pulled from the pistol (FIG. 9). Slide 12 and barrel 11 are now free to be removed by moving them forward and away from the pistol frame section 29 (FIG. 10). FIG. 11 shows lock axle 42 as removed from is pivot socket section 57 mounted below barrel 11.

Turning now to FIGS. 12–15 showing the alternative embodiment, it is seen that the ejector lever **16*a* is shaped to be positioned by magazine 22 in pistol 10. The ejector ear portion 61 of cartridge lip 28 engages the magazine 22 on one side while body ear portion 62 engages the magazine 22 on its opposite side (FIGS. 12 and 13), to control lever 16*a*** and assist in preventing its forward motion.

Also carried by ejector lever **16*a* is rearward stop projection 63 which engages frame 29 when lever 16*a* is urged backward by the forces associated with the cartridge ejection. Engagement of stop 63 with frame 29 limits the rearward movement of lever 16*a***.

Figure 14:
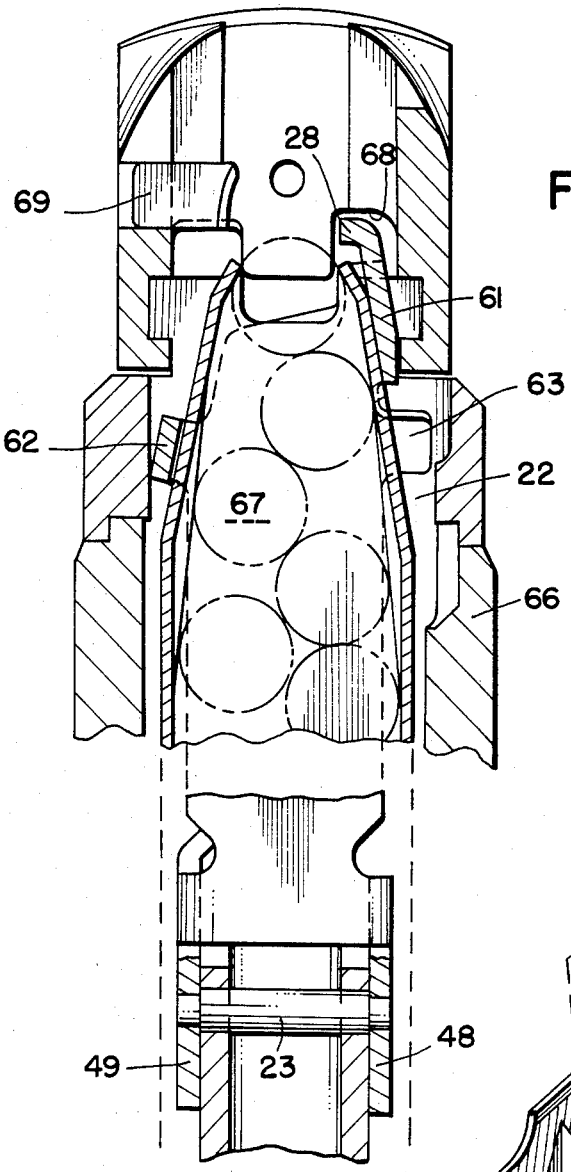
FIG. 14 is an exploded sectional view similar to FIG. 13.
Figure 15:
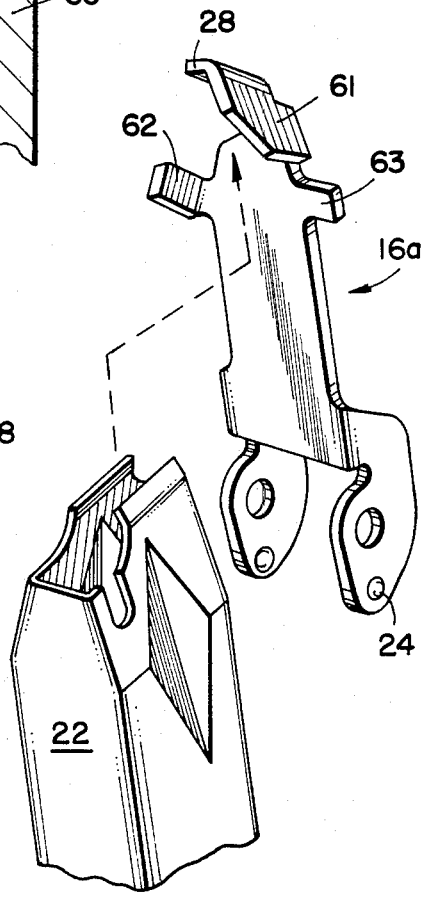
FIG. 15 is a perspective view of the ejector lever and a portion of the magazine in spaced relationship.

Further shown in FIGS. 12–15 are grip panels 66, cartridges 67 in magazine 22 and a longitudinal slide slot 68 for accommodating the cartridge lip 28 as slide 22 reciprocates. Extractor 69 is also shown (FIG. 14).

Figure 16:
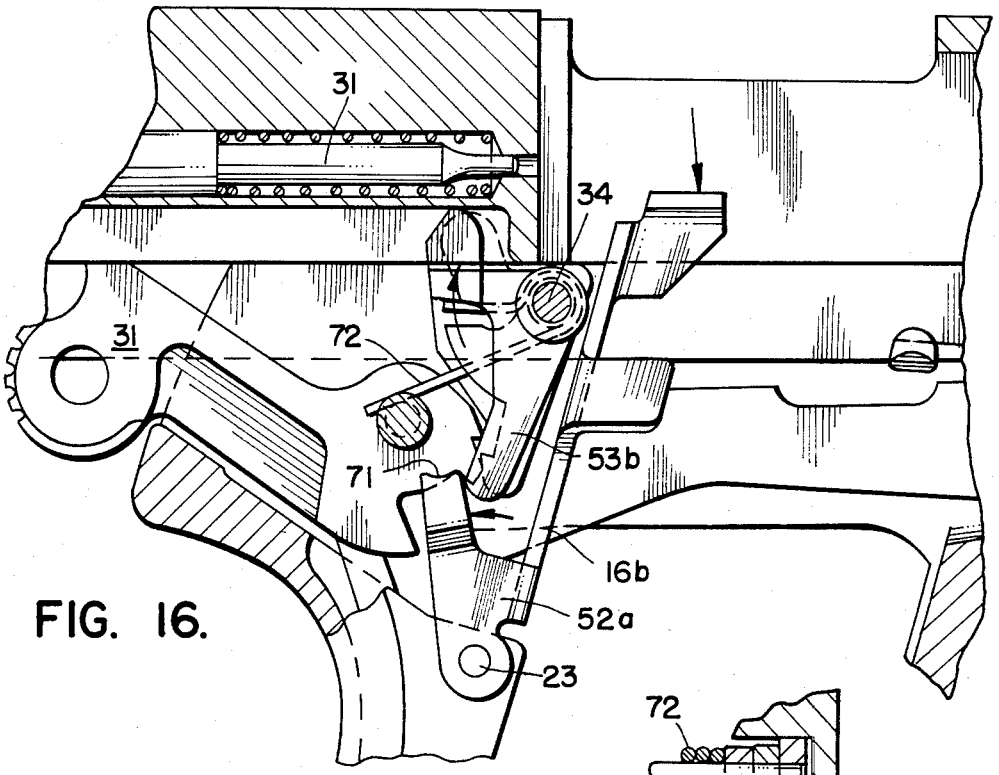
FIG. 16 is a partial side elevational view showing another embodiment of the ejector-lever having a recessed winged extension.
Figure 18:
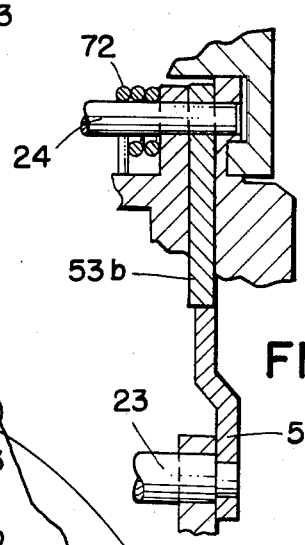
FIG. 18 is a sectional view taken along line 18—18 of FIG. 17.
Figure 17:
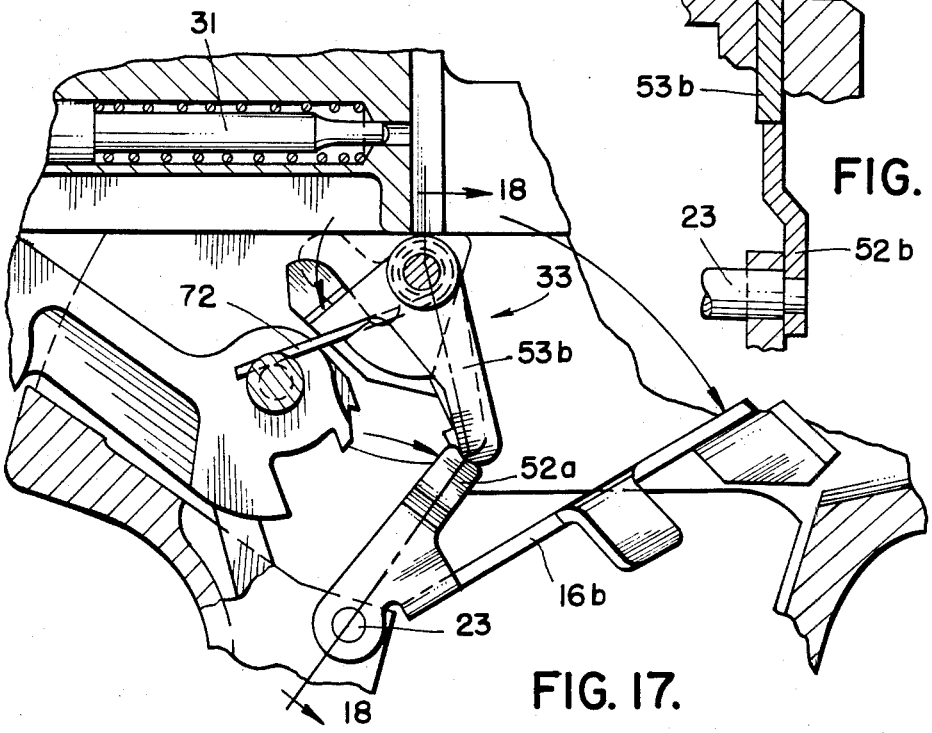
FIG. 17 is an enlarged partial side elevational view showing the ejector-lever depressed to its second block-release position and in engagement with the block extension.
Figure 19:
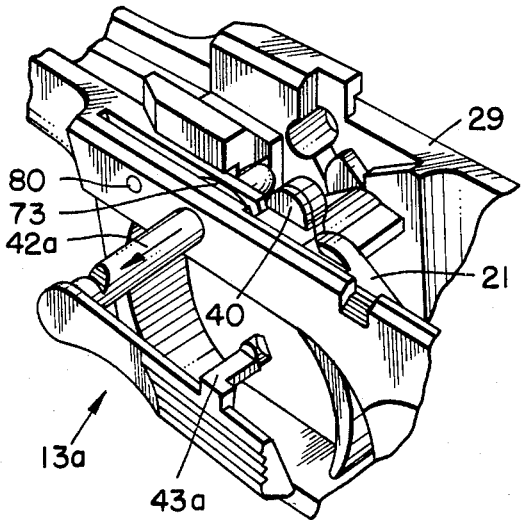
FIG. 19 is a partial perspective view of the pistol showing an alternative embodiment of the slide stop and retaining spring.
Figure 20:
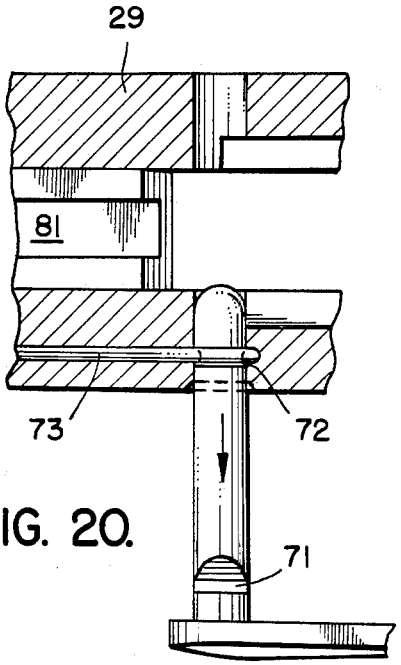
FIG. 20 is a partial cutaway plan view showing the alternative embodiment with the slide stop pulled out.
Figure 21:
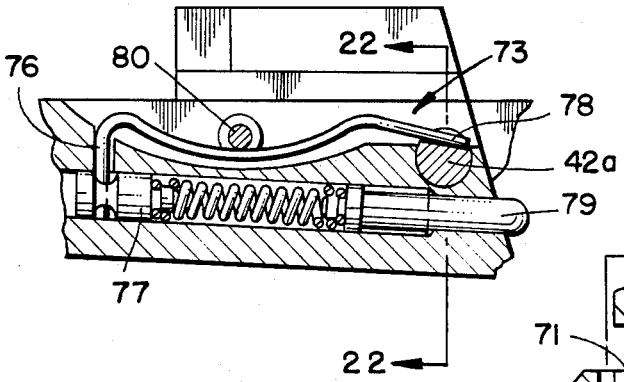
FIG. 21 is a partial sectional elevational view along line 21—21 of FIG. 22.
Figure 22:
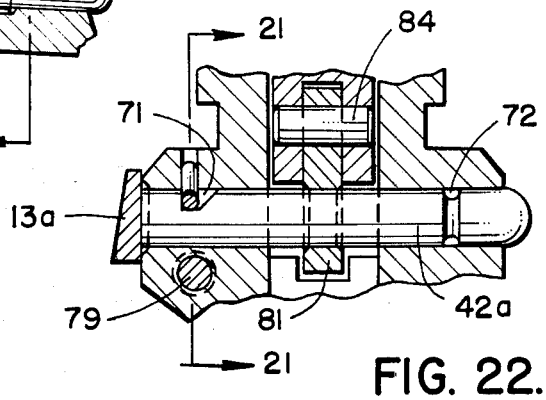
FIG. 22 is a partial cutaway plan view taken along line 22—22 of FIG. 21.

Finally, with respect to FIGS. 16–18, a further embodiment is shown wherein ejector-lever **16*b* has a winged extension 52*a* shaped with a recessed end portion 71 to engage and hold blocking piece extension 53*b* in the blocking piece release position shown in FIG. 17. The shape, length and configurations of ejector-lever extension 52*a* including recess 71; the shape, length and configuration of blocking piece extension 53*b* and the force of blocking piece spring 72 cause the ejector-lever 16*b* to be held down in the position of FIG. 17 without the use of detents 24 and 54** of the earlier described embodiment.

To cause ejector **16*b* to be restored to its FIG. 16 position the ejector 16*b* can be manually pulled back with one's finger or the insertion of the magazine 22 will automatically reposition ejector 16*b* allowing blocking piece 33 to return to operating position via blocking piece spring 72**.

Turning finally to FIGS. 19–22, a further embodiment of the slide latching arrangement is shown in which slide stop latch **13*a* has a lock pivot axle 42*a* and latch element 43*a*. Lock axle 42*a* includes outer slot 71 and inner slot 72. Retention spring 73 engages in slot 71 to position slide stop latch 13*a* in its normal functioning position. When latch 13*a* is pulled out (FIG. 20) for slide removal retention spring 73 engages slot 72 to prevent full removal of latch 13*a* with the advantage of holding latch 13*a* in a ready convenient position without the disadvantage of complete removal and possible loss of mislaying of the part. Retention spring 73 is mounted with one spring end 76 in trigger bar spring plug 77 and the other spring end 78 against pivot axle 42*a* (see FIG. 21**).

Also shown in FIGS. 19–22, are triggger 21, frame 29, trigger bar 40, trigger bar plunger 79, retainer spring pin 80, barrel link 81 and link pivot pin 84.

We claim:

1. In a semi-automatic firearm having a frame, a reciprocating slide, a magazine, a cartridge, a cartridge ejector port, a firing pin mounted for reciprocal movement in the slide as urged toward the cartridge by its momentum as the slide reciprocates and away from the cartridge as urged by a spring, a rotatable firing pin blocking piece and a slide latch for latching and unlatching for slide removal, the improvement comprising (a) an elongated cartridge ejector means including a base portion pivotally mounted on the frame and a stem portion extendable into the cartridge ejection port for ready engagement by the hand of the firearm operator through the cartridge ejection port;

(b) position means on the frame and on the ejector base portion for holding the ejector means in two (2) distinct positions; a first position in which the stem portion is positioned in the cartridge ejection port for ejecting cartridges during operation of the firearm and a second position;

(c) extension means on the ejector means for engagement with the firing pin blocking piece to cause the blocking piece to rotate to unblock the firing pin when the ejector means is moved to such second position; and (d) slide latch release means mounted for rotation in the frame, said latch release means having a pivot axle with a pair of notches therein and spring means mounted adjacent the stop pivot for (1) resilient engagement in one notch to hold the pivot axle for rotation and for (2) resilient engagement in the second notch to hold the pivot in a partial withdrawn position to permit slide removal.

2. In a semi-automatic firearm having a frame, a reciprocating slide, a magazine, a cartridge, a cartridge ejector port, a firing pin mounted for reciprocal movement in the slide as urged toward the cartridge by its momentum as the slide reciprocates and away from the cartridge as urged by a spring, a rotatable firing pin blocking piece mounted on the frame, the improvement comprising (a) an elongated cartridge ejector means including a base portion pivotally mounted on the frame and a stem portion extendable into the cartridge ejection port for ready engagement by the hand of the firearm operator through the cartridge ejection port;

(b) positioning means on the frame and on the ejector base portion for holding the ejector means in two (2) distinct positions; a first position in which the stem portion is positioned in the cartridge ejection port for ejecting cartridges during operation of the firearm and a second position; and (c) extension means on the ejector means for engagement with the firing pin blocking piece to cause the blocking piece to rotate to unblock the firing pin when the ejector means is moved to such second position.

3. The improvement of claim 2 in which the positioning means are detent means on the frame and base portion for holding the ejector means in two (2) distinct positions.

4. The improvement of claim 2 in which the positioning means include the ejector means having wing means for engaging a blocking piece extension and with blocking piece extension are held in angled engagement by action of a blocking piece spring.

5. The improvement of claim 2 in which the ejector base portion includes two connected wings mounted on either side of the frame.

6. The improvement of claim 2 in which the ejector means includes locating ear portions for locating the ejector means with respect to the magazine in the firearm.

7. The improvement of claim 2 in which the ejector means includes a stop portion which is engageable with the frame.

* * * * *